US008120449B2

(12) United States Patent
Aigle et al.

(10) Patent No.: US 8,120,449 B2
(45) Date of Patent: Feb. 21, 2012

(54) MAGNETICALLY TUNABLE FILTER WITH COPLANAR LINES

(75) Inventors: Michael Aigle, Sauerlach (DE); Claus Tremmel, Haar (DE); Dirk Schneiderbanger, Erlangen (DE); Robert Rehner, Erlangen (DE); Michael Sterns, Erlangen (DE); Lorenz-Peter Schmidt, Hessdorf (DE); Sigfried Martius, Forchheim (DE)

(73) Assignee: Rohde & Schwarz GmbH & Co. KG, München (DE)

( * ) Notice: Subject to any disclaimer, the term of this patent is extended or adjusted under 35 U.S.C. 154(b) by 687 days.

(21) Appl. No.: 12/279,092

(22) PCT Filed: Jul. 4, 2007

(86) PCT No.: PCT/EP2007/005927

§ 371 (c)(1),
(2), (4) Date: Aug. 26, 2008

(87) PCT Pub. No.: WO2008/003483

PCT Pub. Date: Jan. 10, 2008

(65) Prior Publication Data

US 2009/0039983 A1 Feb. 12, 2009

(30) Foreign Application Priority Data

Jul. 4, 2006 (DE) ..... 10 2006 030 882
Nov. 13, 2006 (DE) ..... 10 2006 053 416
Jan. 12, 2007 (DE) ..... 10 2007 001 832

(51) Int. Cl.
*H01P 1/203* (2006.01)
*H01P 7/00* (2006.01)

(52) U.S. Cl. ..... 333/205; 333/34; 333/35; 333/219.2

(58) Field of Classification Search ..... 333/202, 333/203, 204, 205, 208, 209, 212, 219.2, 333/34, 35
See application file for complete search history.

(56) References Cited

U.S. PATENT DOCUMENTS 3,368,169 A 2/1968 Carter et al.
3,400,343 A 9/1968 Carter
4,600,906 A 7/1986 Blight
4,888,569 A 12/1989 Nicholson et al.
5,343,176 A * 8/1994 Hasler ..... 333/204

OTHER PUBLICATIONS

Carter, "Side-Wall-Coupled, Strip-transmission-Line Magnetically Tunable Filters Employing Ferrimagnetic YIG Resonators," *IEEE Trans. on Microwave Theory and Techniques*, MTT-13:306-315 (1965).
Phel, "Mikrowellentechnik Wellenleitungen und Leitungsbausteine," Dr. Alfred Huthig Verlag Heidelberg, pp. 84-89 (1984).
International Search Report for PCT/EP2007/005927 dated Oct. 8, 2007.

* cited by examiner

*Primary Examiner* — Robert Pascal
*Assistant Examiner* — Hardadi Sumadiwirya
(74) *Attorney, Agent, or Firm* — Marshall, Gerstein & Borun LLP

(57) ABSTRACT

The invention relates to a magnetically tunable filter having a filter housing and having two tunable resonator spheres which comprise magnetizable material and are arranged next to one another in two filter branches. Each filter branch comprises a coplanar line arranged on a substrate layer and extending in the direction of an electrical connection, as well as a common coupling opening so that the two filter branches are connected to one another. A resonator sphere is respectively positioned on each side of the coupling opening inside the two filter branches.

43 Claims, 5 Drawing Sheets

MAGNETICALLY TUNABLE FILTER WITH COPLANAR LINES

BACKGROUND OF THE INVENTION

1. Field of the Invention

The invention relates to a magnetically tunable filter.

2. Related Technology

Magnetically tunable filters are employed, for example, as variable bandpass filters in spectrum analyzers and network analyzers, the desired resonant frequency being adjusted by means of an external variable magnetic field.

U.S. Pat. No. 4,888,569 discloses a variable bandpass filter for frequencies within a frequency range of at most one waveguide band, for example 50-75 GHz, with four resonator spheres. The variable bandpass filter comprises an input waveguide, an output waveguide and a transfer waveguide, which are configured for the propagation of a $TE_{10}$ wave mode. The end of the input waveguide terminated by a short-circuit wall, the start of the output waveguide which is likewise provided with a short-circuit wall, and the transfer waveguide fitted below the input waveguide and the output waveguide in the direction of the externally applied homogeneous magnetic field, is arranged during operation between two magnet poles which supply a variable magnetic field for adjusting a resonant frequency. In the direction of the wave propagation, the input waveguide and output waveguide have a rectangular profile which has a much smaller cross-sectional area in the coupling region than at the connection flange. The coupling region of the variable bandpass filter comprises the four resonator spheres, fitted close to a short-circuit wall, and respectively the tapered ends of the input waveguide and of the output waveguide, as well as the transfer waveguide with a constant cross-sectional area.

A disadvantage of the variable bandpass filter described in U.S. Pat. No. 4,888,569 is that in the resonant case the field distribution of the wave to be extracted is unfavourable in the coupling region, since it is guided in a waveguide whose profile is reduced towards the coupling region perpendicularly to the propagation direction of the wave to be extracted. This causes undesired reflections which are destructively superposed and therefore reduce the amount of energy transported by the incoming wave. This effect also pertains to the outgoing wave in the output waveguide, which now has a defined frequency, so that overall the insertion loss in relation to the entry of the input waveguide and the exit of the output waveguide is increased since the field distributions in the coupling region are perturbed owing to the tapering geometry of the waveguides.

Another disadvantage is the limited bandwidth of the waveguide concept.

SUMMARY OF THE INVENTION

Therefore, the invention provides a magnetically tunable filter for high frequencies, which has an insertion loss being as low as possible in the resonant case and which has very high isolation of the filter input and the filter output in the off-resonance case.

The invention provides a magnetically tunable filter having a filter housing and two tunable resonator spheres comprising magnetizable material and arranged next to one another in two filter branches, each filter branch comprising a coplanar line arranged on a substrate layer and extending in the direction of an electrical connection, the two filter branches being connected by a common coupling opening and a resonator sphere respectively being positioned on each side of the coupling opening inside the two filter branches.

The magnetically tunable filter according to the invention comprises a filter housing and two tunable resonator spheres made of magnetisable material. These are arranged next to one another in two filter branches, each filter branch comprising a coplanar line formed on a substrate layer and extending in the direction of an electrical connection, i.e. in the direction of the signal input or in the direction of the signal output. The two filter branches are connected to one another by a common coupling opening, and they have a common filter housing. On either side of the coupling opening, the resonator spheres are arranged on each side inside the two filter branches.

The advantages achieved by the invention are in particular that the magnetically tunable filter according to the invention comprises two coplanar lines, so as to ensure good guiding of the incoming electromagnetic wave and the outgoing wave. The coplanar lines do not have a bottom cut-off frequency.

It is furthermore advantageous that the resonator spheres are positioned in the vicinity of a short circuit, since here, over a large frequency range, a magnetic field maximum occurs which is independent of the frequency of the incoming electromagnetic wave. Owing to the coupling structure and the line type of the coplanar line, the working range of the filter according to the invention is relatively wide in respect of the frequency and is therefore very suitable for a frequency range to be filtered, for example from 40 GHz to 75 GHz.

Furthermore, the coplanar lines which are used offer the advantage that they have a defined characteristic impedance so that good coupling of the resonator spheres can be adjusted. The characteristic impedance of the coplanar line in the vicinity of the resonator spheres is also easy to match by using a $\lambda/4$ transformer or a taper.

Furthermore, the coplanar line is preferably formed on a substrate whose dielectric constant is as low as possible, in order to keep the wavelength as large as possible in comparison with the diameter of the resonator spheres. A long wavelength in comparison with the diameter of the resonator spheres reduces the excitation of perturbing higher order modes, since the magnetic field distribution in the volume of the resonator spheres is more homogeneous with a long wavelength than with a shorter wavelength.

It is also advantageous for the two coplanar lines to be fully embedded in metal channels, so that they are substantially surrounded by metal walls. In the resonant case, energy transfer is made possible by connecting these channels, or the filter branches, to one another through a coupling opening, the coupling opening being designed differently according to the various exemplary embodiments or optionally comprising irises with geometrically different or differently positioned iris apertures.

A coupling opening partially closed by means of a metal separating wall has the advantage that the resonator spheres do not have any direct line of sight with one another. The height of the separating wall is in this case advantageously selected so that although line of sight between the resonator spheres is prevented, a sufficient coupling factor is nevertheless still ensured. This is a significant difference from all previous concepts.

BRIEF DESCRIPTION OF THE DRAWINGS

Both the structure and the functionality of the invention, as well as its further advantages and objects, will however be best understandable with the aid of the following description in conjunction with the associated drawings. In the drawings.

DETAILED DESCRIPTION

Throughout the figures, parts which correspond to one another are provided with the same references so that repeated description is superfluous.

Figure 1:
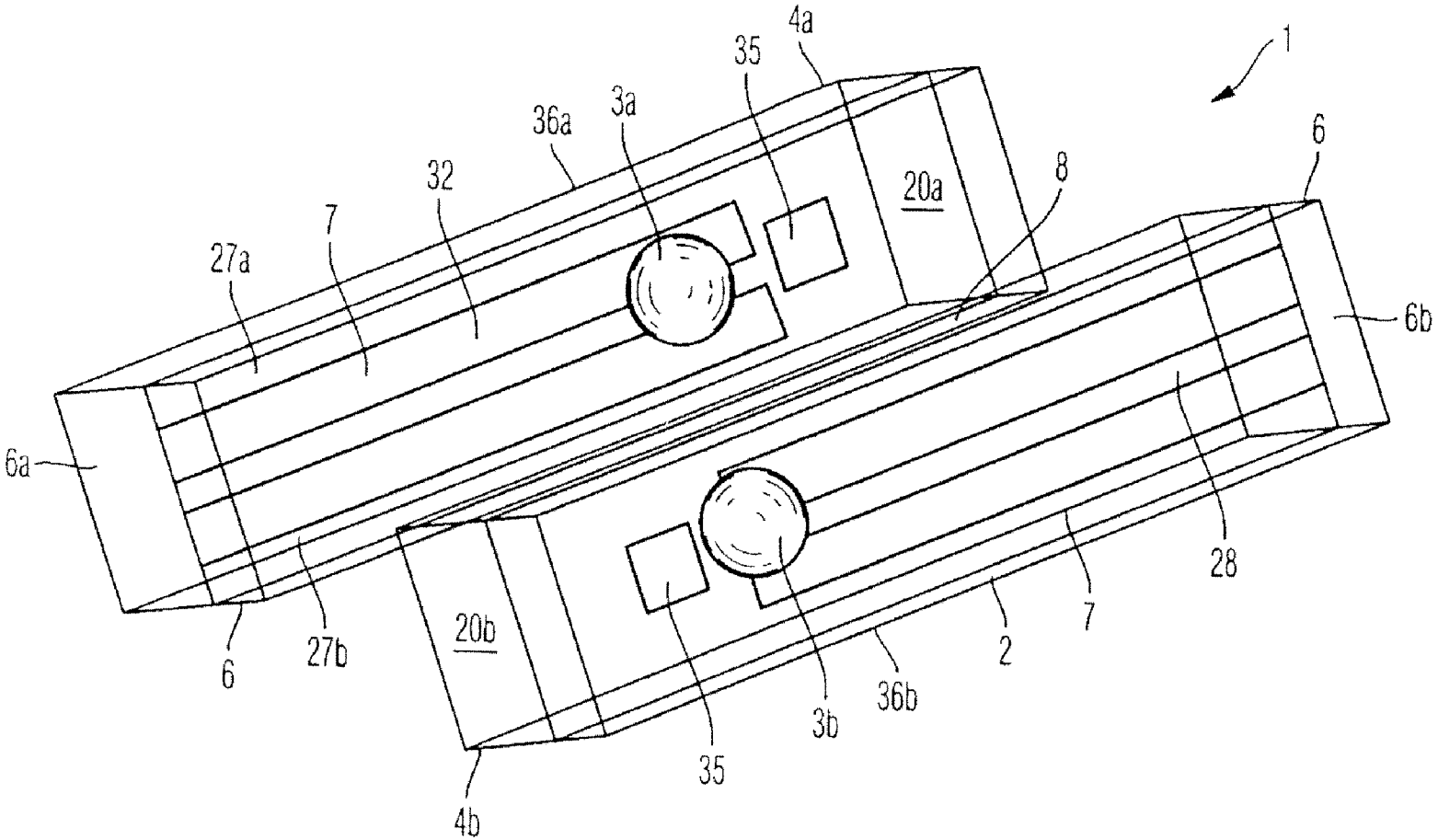
FIG. 1 shows a perspective representation of a schematically represented structure of a first exemplary embodiment of the magnetically tunable filter according to the invention.

FIG. 1 shows a perspective representation of a schematically represented structure of a first exemplary embodiment of the magnetically tunable filter 1 according to the invention, having a filter housing 2 and having two tunable resonator spheres 3*a*, 3*b* made of magnetisable material, in particular hexaferrite. The overall filter housing 2 comprises two filter branches 4*a*, 4*b*, as well as a signal input 6*a* and a signal output 6*b*, the resonator spheres 3*a*, 3*b* being arranged next to one another in the two filter branches 4*a*, 4*b*.

Each of the two filter branches 4*a*, 4*b* contains a coplanar line 7 formed on a substrate layer 5 and extending in the direction of an electrical connection 6, the substrate layer 5, which preferably has a low dielectric constant, being arranged on the metal bottom 10 of the filter branch 4*a*, 4*b*. The two adjacent and touching filter branches 4*a*, 4*b* are connected to one another through a common coupling opening 8, a resonator sphere 3*a*, 3*b* respectively being positioned on each side of the coupling opening 8 above the coplanar line 7 inside the two filter branches 4*a*, 4*b*.

The coplanar line 7 comprises two outer line strips 27*a*, 27*b* and a central line strip 28, which lie on the same side of the substrate layer 5, away from the metal bottom 10, and have a short-circuit region 31 in the end region 30 of the filter branch 4*a*, 4*b*. In the short-circuit region 31, the two outer line strips 27*a*, 27*b* and the central line strip 28 are connected conductively to one another by a metal layer. Provided in the short-circuit region 31, there is furthermore a through-contact 35 which conductively connects the metal layer through the substrate layer 5 to the bottom of the filter branch 4*a*, 4*b*, or of the filter housing 2.

These waveguide-coupled coplanar lines 7 have the advantage that the fields are concentrated in the vicinity of the central line strip 28 and the nonconductive slots 29*a*, 29*b*, the current density in the longitudinal direction having maximum values in the vicinity of the short-circuit region 31. The effect achieved by the coplanar line 7 embedded in the metal filter housing 2 is therefore good and guiding, defined by the line geometry, of the electromagnetic wave to be transported.

Figure 2:
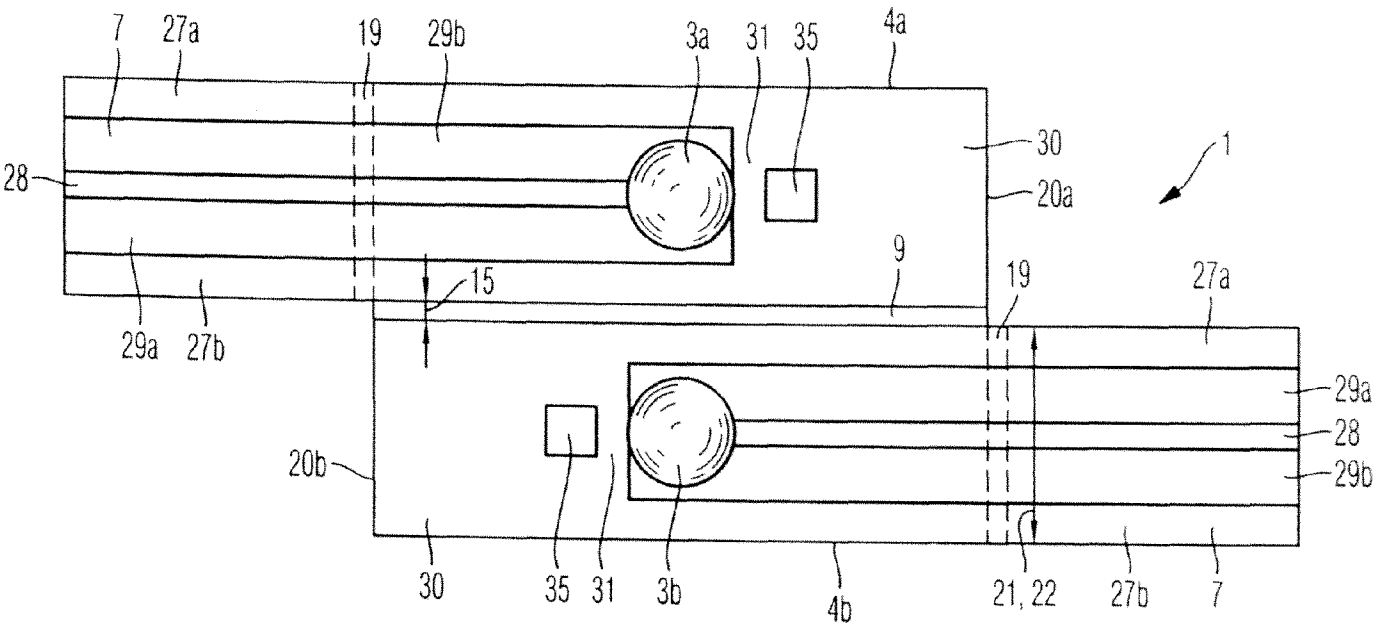
FIG. 2 shows a plan view of a schematically represented structure of a second exemplary embodiment of the magnetically tunable filter according to the invention.

FIG. 2 shows a plan view of a schematically represented structure of a second exemplary embodiment of the magnetically tunable filter 1 according to the invention. In the common coupling opening 8, there is now a first thin separating wall 9 which extends between the respective substrate layers 5 of the filter branches 4*a*, 4*b* as far as the metal bottom 10 of the filter housing 2. On either side of this separating wall 9, whose thickness 15 is defined by two arrows and is for example between 10 μm-100 μm, preferably about 50 μm, the resonator spheres 3*a*, 3*b* which consist of a ferrimagnetic or ferromagnetic material and have a diameter of for example 100 μm-1000 μm, preferably approximately 300 μm, are bonded on a quartz carrier (not further represented) using epoxy adhesive. The quartz carrier with the resonator spheres 3*a*, 3*b* is placed in the short-circuit region 31 of the coplanar line 7.

The dashed lines which extend parallel to the signal input 6*a* and the signal output 6*b*, respectively, each indicate a second thin separating wall 19 which in this second exemplary embodiment of the magnetically tunable filter according to the invention is additional relative to the exemplary embodiment shown in FIG. 1 and will be described in more detail with the aid of FIG. 3.

Figure 3:
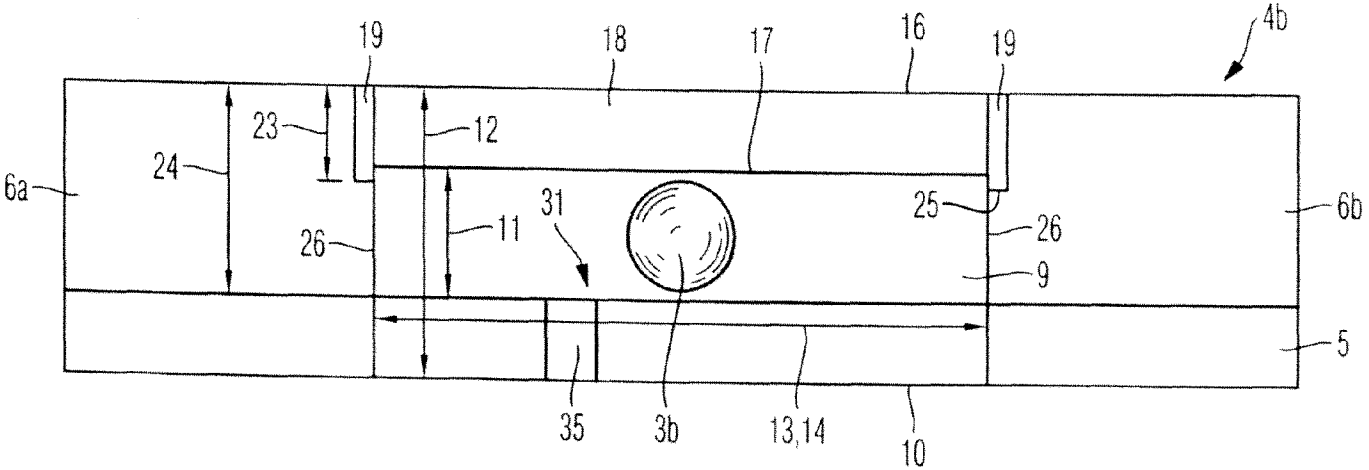
FIG. 3 shows a side view of a schematically represented structure of the second exemplary embodiment of the magnetically tunable filter according to the invention.

FIG. 3 shows a side view of a schematically represented structure of the second exemplary embodiment of the magnetically tunable filter 1 according to the invention, with the first separating wall 9 fitted centrally with respect to the two filter branches 4*a*, 4*b* and with the second separating wall 19, which was indicated merely as a dashed line in FIG. 2.

In this side view, it may be seen that the height 11 of the first separating wall 9 is less than the total height 12 of the filter housing 2, or of the filter branch 4*a*, 4*b*, so that this first separating wall 9 prevents direct line of sight between the two resonator spheres 3*a*, 3*b* which are arranged on either side of the first separating wall 9.

Between a lid 16 of the filter housing 2 and an upper edge 17 of the first separating wall 9, which extends inside and parallel to the coupling opening 8 and whose length 13 corresponds to the length 14 of the coupling opening 8, there is therefore a first quadrilateral gap 18.

In an additional embodiment of the magnetically tunable filter according to the invention (not further represented), instead of the first separating wall 9 inside the common coupling opening 8 of the filter branches 4*a*, 4*b*, it is also possible to fit an iris which extends from the bottom 10 of the filter housing 2 as far as the lid 16 of the filter housing 2 and has an arbitrarily shaped and positioned iris aperture. The iris aperture may for example be circular, elliptical, rectangular, triangular, or have the shape of a polygon.

The second separating wall 19 is provided inside the filter branches 4*a*, 4*b* and respectively stands perpendicularly to the longitudinal direction of the coplanar line 7 and the first separating wall 9, the length 21 of the second separating wall 19 corresponding to the width 22 of a filter branch 4*a*, 4*b* and being positioned inside one filter branch 4*a* approximately in the vicinity of a short-circuit wall 20*b* of the neighbouring filter branch 4*b*, which may be seen clearly in the plan view of FIG. 2.

It may furthermore be seen from FIG. 3 that the second separating wall 19 in the exemplary embodiment is fastened to the lid 16 of the filter housing 2, the height 23 of the second separating wall 19 being less than the distance 24 between the substrate layer 5 and the lid 16 of the filter housing 2, so that a second gap 26 with an essentially quadrilateral profile is formed between a lower edge 25 of the second separating wall 19 and the substrate layer 5 with the coplanar line 7.

Figure 4:
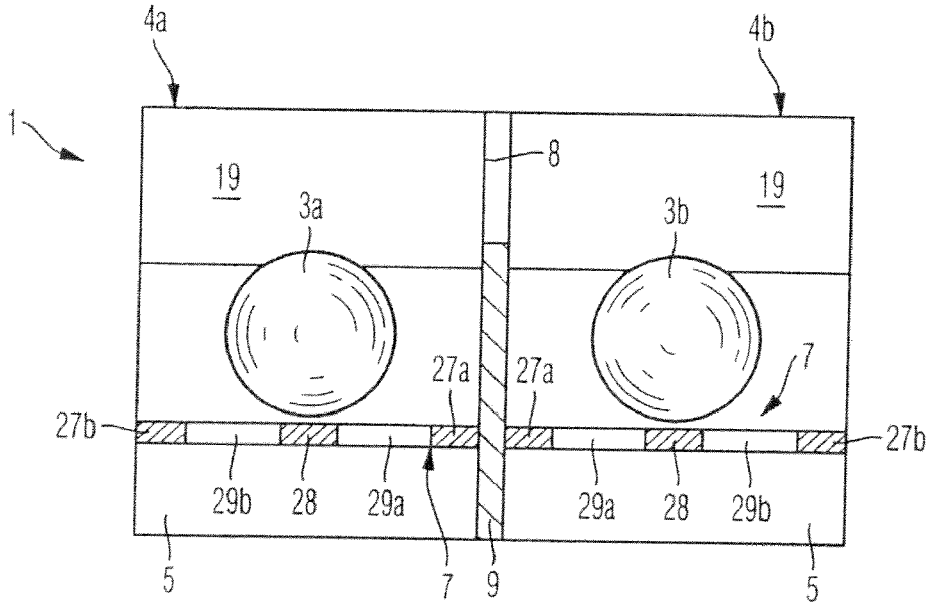
FIG. 4 shows a front view of a schematically represented structure of the second exemplary embodiment of the magnetically tunable filter according to the invention.

FIG. 4 shows a front view of a schematically represented structure of the second exemplary embodiment of the magnetically tunable filter 1 according to the invention, with the first separating wall 9 and the second separating walls 19. The two resonator spheres 3*a*, 3*b* are arranged mirror-symmetrically to one another on either side of the coupling opening 8, or on the near and far sides of the first separating wall 9. The midpoint of the resonator spheres 3*a*, 3*b* lies approximately above the symmetry line of the central line strip 28 of the coplanar line 7, so that each resonator sphere 3*a*, 3*b* lies at the maximum of the magnetic field and optimal excitation of the desired resonant frequency can be carried out via the magnetic field of the radiofrequency source, the region selected for positioning the resonator spheres 3*a*, 3*b* being characterized in that the magnetic field maximum occurs in this region independently of the frequency of the incoming or outgoing electromagnetic wave.

The coplanar line 7, which for example has a characteristic impedance of 50 Ω, is formed on a substrate layer 5 which has a preferably low dielectric constant. The sphere diameter of the resonator spheres 3*a*, 3*b*, i.e. for example 300 μm, is therefore much less than the wavelength of the incoming and outgoing waves. The excitation of perturbing higher order modes is therefore reduced, since the magnetic field distribution in the sphere volume is more homogeneous with a long wavelength than with a wavelength whose dimension is only a little larger than the sphere diameter of the resonator spheres 3*a*, 3*b*. The first separating wall 9 between the two resonator spheres 3*a*, 3*b*prevents direct coupling of stray fields in the vicinity of the resonator spheres 3*a*, 3*b*, so that high decoupling is obtained away from resonance.

Figure 5:
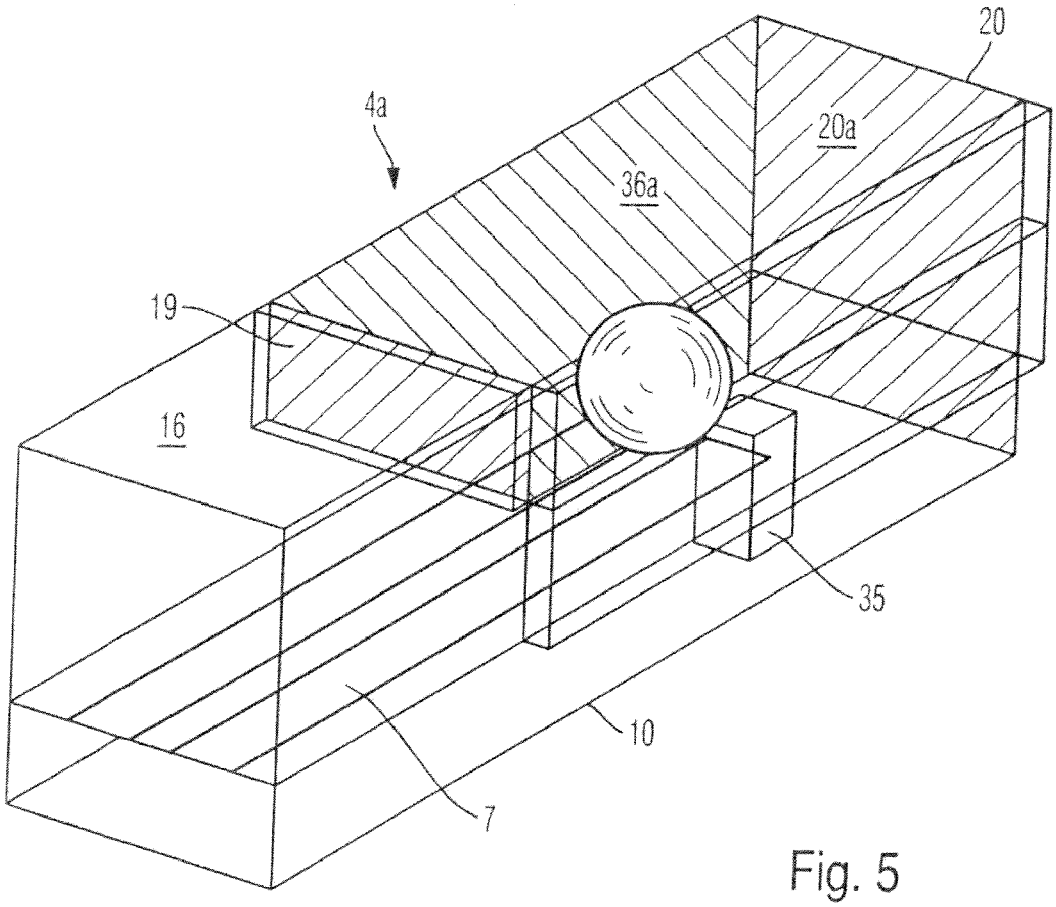
FIG. 5 shows a perspective representation of a schematically represented structure of a filter branch according to the second exemplary embodiment of the magnetically tunable filter according to the invention.

FIG. 5 shows a perspective representation of a schematically represented structure of a filter branch 4*a* according to the second exemplary embodiment of the magnetically tunable filter 1 according to the invention, with the two separating walls 9 and 19. This filter branch 4*a* forms one half of a cavity resonator or connecting resonator 32 for an $H_{10}$ wave mode, the walls of the connecting resonator 32 being formed by the bottom 10 of the filter housing, the two second separating walls 19, the two sidewalls 36*a*, 36*b* and the two short-circuit walls 20*a*, 20*b* of the filter branches 4*a*, 4*b*, and the lid 16 of the filter housing 2. The sidewall 36*a* and the short-circuit wall 20*a* are marked by shading in this representation.

In the short-circuit region of the filter branch 4*a*, it may now be seen clearly that the through-contact 35 connects the metal layer of the coplanar line 7 to the metal bottom 10 of the filter branch 4*a*.

Figure 6:
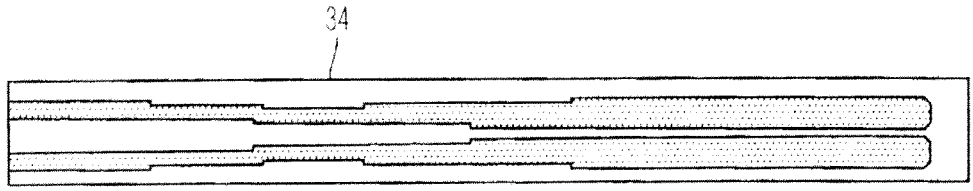
FIG. 6 shows a first embodiment of the end region of the coplanar line of the magnetically tunable filter according to the invention.

FIG. 6 shows a first embodiment of the end region of the coplanar line 7 of the magnetically tunable filter 1 according to the invention. The coplanar line is designed as a λ/4 transformer 34 in this region, in order to match the characteristic impedance of the input coplanar line 7 to the characteristic impedance of the coplanar line in the sphere region with the resonator spheres.

Figure 7:
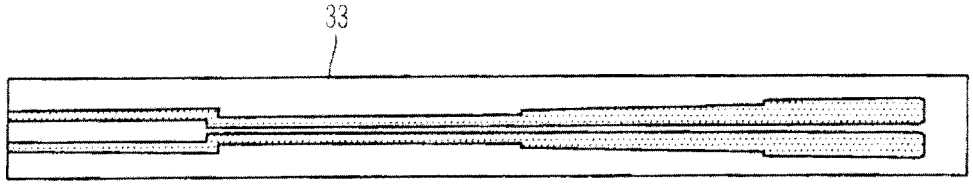
FIG. 7 shows a second embodiment of the end region of the coplanar line of the magnetically tunable filter according to the invention.

FIG. 7 shows a second embodiment of the end region of the coplanar line 7 of the magnetically tunable filter 1 according to the invention. The coplanar line is designed as a taper 33 in this region, in order to match the characteristic impedance of the coplanar line 7 to the characteristic impedance of the connecting resonator 32 with the resonator spheres.

Figure 8:
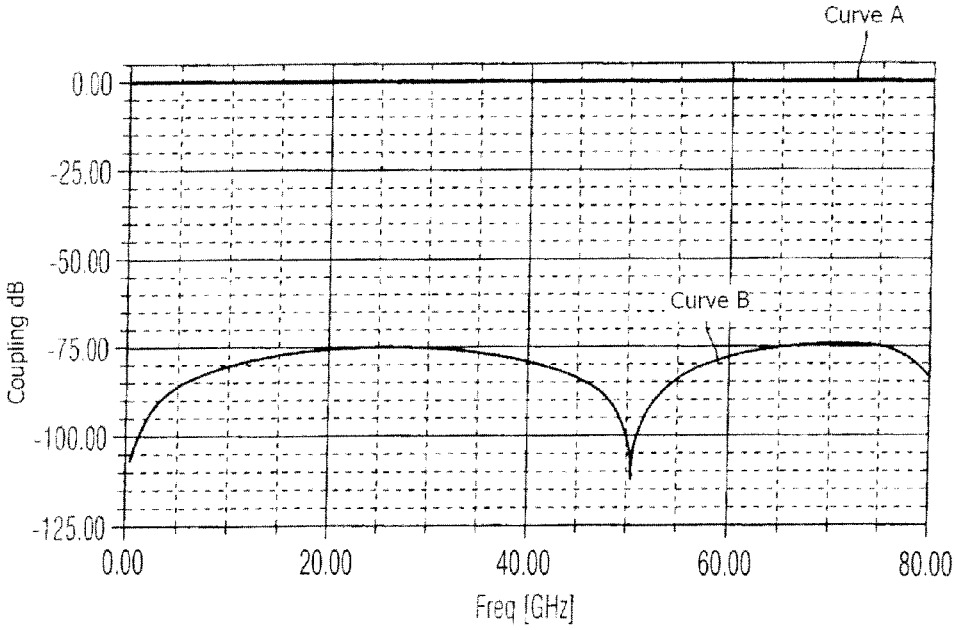
FIG. 8 shows the simulated off-resonance isolation profile of the magnetically tunable filter according to the invention.

FIG. 8 shows the simulated isolation profile of the magnetically tunable filter 1 according to the invention in the off-resonance case (isolation), curve A giving the magnitude of the scattering matrix element $S_{11}$ and curve B giving the frequency-dependent magnitude of the scattering matrix element $S_{12}$ of the filter according to the invention, treated as a two-port network. The values of curve B lie in a range of from −75 dB to −115 dB, and they confirm that electromagnetic waves whose frequency lies outside the resonant frequency are attenuated very strongly by the filter 1 according to the invention.

Figure 9:
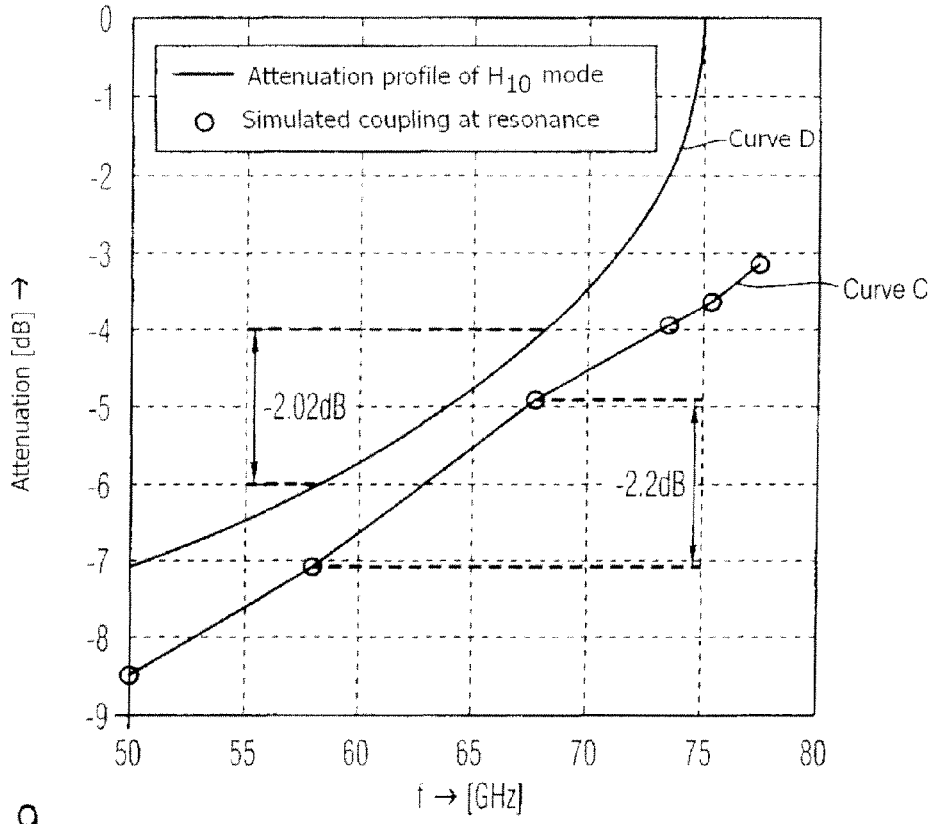
FIG. 9 shows the simulated profile of the coupling as a function of the resonant frequency of the magnetically tunable filter according to the invention as well as the simulated attenuation loss of the $H_{10}$ mode of a 2 mm wide and 0.7 mm long coupling waveguide.

FIG. 9 shows the simulated profile of the coupling (curve C) as a function of the resonant frequency of the magnetically tunable filter 1 according to the invention as well as the simulated attenuation loss (curve D) of the $H_{10}$ mode of a 2 mm wide waveguide with a length of 0.7 mm. Curve C and curve D show that the frequency-dependent change in the attenuation of a filter 1 according to the invention, when the resonant frequency increases by approximately 17 GHz, corresponds essentially to the frequency-dependent change in the attenuation of the $H_{10}$ mode in the coupling waveguide with the aforementioned dimensions, which clearly shows that the $H_{10}$ wave mode propagates in the connecting cavity 32 in the resonant case. The absolute attenuation value in the resonant case lying between −3 dB and −8.5 dB is orders of magnitude less than the values in the decoupling case (isolation) shown in FIG. 8.

Figure 10:
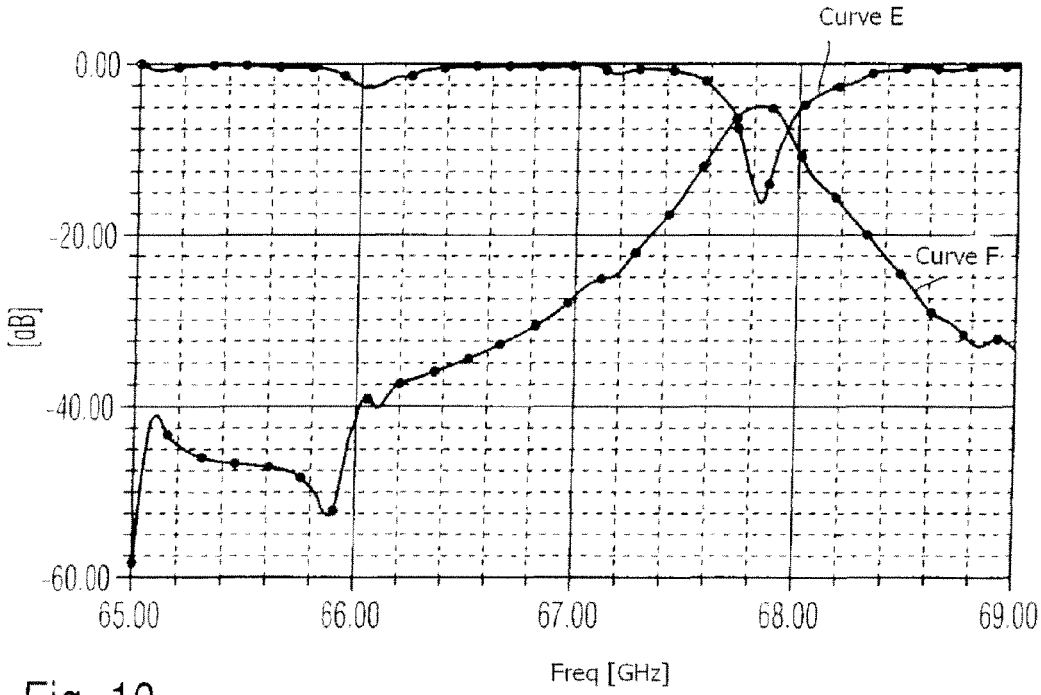
FIG. 10 shows a simulated resonance profile of the magnetically tunable filter according to the invention for a resonant frequency of 67.8 GHz.

FIG. 10 shows a simulated resonance profile of the magnetically tunable filter 1 according to the invention for a desired central frequency of 68 GHz. Curve E shows the frequency-dependent profile of the absorption curve with an absorption maximum at 67.8 GHz and a full width at half maximum of 0.2 GHz and a frequency spread (FWHM) of approximately 0.3%. Curve F shows the frequency-dependent profile of the transmission curve with a pronounced maximum likewise at 67.8 GHz. It may be seen clearly that the frequency positions of the absorption maximum and the transmission maximum coincide very well.

The invention is not restricted to the exemplary embodiments represented in the drawings, and in particular not to a filter housing without separating walls. All features described above and represented in the drawing may be combined with one another in any desired way.

The invention claimed is:

1. Magnetically tunable filter comprising a filter housing and two tunable resonator spheres that comprise magnetizable material and are arranged next to one another in two filter branches, each filter branch comprising a coplanar line arranged on a substrate layer and extending in a direction of an electrical connection, the two filter branches being connected by a common coupling opening and the two resonator spheres respectively being positioned on each side of the coupling opening inside the two filter branches, wherein the coupling opening common to the two filter branches adjoins a first thin separating wall, which extends between the respective substrate layers of the two filter branches as far as the bottom of the filter housing, the height of the first separating wall being less than the total height of the filter housing.

2. Magnetically tunable filter according to claim 1, wherein the first separating wall has a length, which extends along and parallel to the coupling opening, corresponds to a length of the coupling opening.

3. Magnetically tunable filter according to claim 1, wherein a thickness of the first separating wall is from 10 μm to 100 μm.

4. Magnetically tunable filter according to claim 1, wherein the first thin separating wall prevents direct line of sight between the resonator spheres arranged on either side of the coupling opening, or on either side of the first separating wall.

5. Magnetically tunable filter according to claim 1, wherein a first quadrilateral gap, which constitutes the coupling opening, is formed between a lid of the filter housing and an upper edge of the first separating wall.

6. Magnetically tunable filter according to claim 1, wherein each substrate layer has a low relative dielectric constant $\in_r$.

7. Magnetically tunable filter according to claim 1, wherein the two resonator spheres each comprise a ferrimagnetic or ferromagnetic material.

8. Magnetically tunable filter according to claim 1, wherein each of the two resonator spheres has a diameter of from 100 μm to 1000 μm.

9. Magnetically tunable filter according to claim 1, wherein the two resonator spheres are arranged mirror-symmetrically to one another on either side of the coupling opening.

10. Magnetically tunable filter according to claim 1, wherein each of the coplanar lines comprising respectively two outer line strips and respectively one central line strip comprise, in the respective end regions of the two filter branches, a short-circuit region where the central line strip of the respective coplanar line is conductively connected to the two outer line strips of the respective coplanar line.

11. Magnetically tunable filter according to claim 1, wherein matching of the characteristic impedance of the respective coplanar line to the characteristic impedance of a connecting resonator formed in the end region of the two filter branches is carried out by a taper.

12. Magnetically tunable filter according to claim 11, wherein the connecting resonator acts as a cavity resonator for an H10 wave mode.

13. Magnetically tunable filter according to claim 1, wherein the matching of the characteristic impedance of the respective coplanar line to the characteristic impedance of a connecting resonator formed in the end region of the two filter branches is carried out by at least one of a $\lambda/4$ transformer and a taper.

14. Magnetically tunable filter according to claim 1, wherein in a respective filter branch, the corresponding resonator sphere is placed in a short-circuit region of the respective coplanar line by a quartz carrier.

15. Magnetically tunable filter according to claim 14, wherein each resonator sphere is bonded on the quartz carrier by an epoxy adhesive.

16. Magnetically tunable filter comprising a filter housing and comprising two tunable resonator spheres that comprise magnetizable material and are arranged next to one another in two filter branches, each filter branch comprising a coplanar line arranged on a substrate layer and extending in a direction of an electrical connection, the two filter branches being connected by a common coupling opening and the two resonator spheres respectively being positioned on each side of the coupling opening inside the two filter branches, wherein the common coupling opening of the two filter branches comprises an iris, which extends from the bottom of the filter housing as far as its lid, the iris having an arbitrarily shaped and positioned iris aperture.

17. Magnetically tunable filter according to claim 16, wherein the iris aperture is circular, elliptical, rectangular, triangular, or has the shape of a polygon.

18. Magnetically tunable filter according to claim 16, wherein each substrate layer has a low relative dielectric constant $\in_r$.

19. Magnetically tunable filter according to claim 16, wherein the two resonator spheres each comprise a ferrimagnetic or ferromagnetic material.

20. Magnetically tunable filter according to claim 16, wherein each of the two resonator spheres has a diameter of from 100 μm to 1000 μm.

21. Magnetically tunable filter according to claim 16, wherein the two resonator spheres are arranged mirror-symmetrically to one another on either side of the coupling opening.

22. Magnetically tunable filter according to claim 16, wherein each of the coplanar lines comprising respectively two outer line strips and respectively one central line strip comprise, in the respective end regions of the two filter branches, a short-circuit region where the central line strip of the respective coplanar line is conductively connected to the two outer line strips of the respective coplanar line.

23. Magnetically tunable filter according to claim 16, wherein matching of the characteristic impedance of the respective coplanar line to the characteristic impedance of a connecting resonator formed in the end region of the two filter branches is carried out by a taper.

24. Magnetically tunable filter according to claim 23, wherein the connecting resonator acts as a cavity resonator for an H10 wave mode.

25. Magnetically tunable filter according to claim 16, wherein the matching of the characteristic impedance of the respective coplanar line to the characteristic impedance of a connecting resonator formed in the end region of the two filter branches is carried out by at least one of a $\lambda/4$ transformer and a taper.

26. Magnetically tunable filter according to claim 16, wherein in a respective filter branch, the corresponding resonator sphere is placed in a short-circuit region of the respective coplanar line by a quartz carrier.

27. Magnetically tunable filter according to claim 26, wherein each resonator sphere is bonded on the quartz carrier by an epoxy adhesive.

28. Magnetically tunable filter comprising a filter housing and two tunable resonator spheres that comprise magnetizable material and are arranged next to one another in two filter branches, each filter branch comprising a coplanar line arranged on a substrate layer and extending in a direction of an electrical connection, the two filter branches being connected by a common coupling opening and the two resonator spheres respectively being positioned on each side of the coupling opening inside the two filter branches, wherein a second separating wall, which is respectively oriented perpendicularly to the coplanar line, is respectively formed inside the two filter branches.

29. Magnetically tunable filter according to claim 28, wherein the second separating wall inside one filter branch is positioned approximately in the vicinity of a short-circuit wall of the other filter branch.

30. Magnetically tunable filter according to claim 28, wherein the second separating wall has a length that corresponds to a width of each filter branch.

31. Magnetically tunable filter according claim 28, wherein the second separating wall is connected to a lid of the filter housing.

32. Magnetically tunable filter according claim 28, wherein the second separating wall has a height that is less than a distance between the substrate layer and the lid of the filter housing.

33. Magnetically tunable filter according to claim 28, wherein a second gap with an essentially quadrilateral profile is formed between a lower edge of the second separating wall and the substrate layer.

34. Magnetically tunable filter according to claim 28, wherein each substrate layer has a low relative dielectric constant $\in_r$.

35. Magnetically tunable filter according to claim 28, wherein the two resonator spheres each comprise a ferrimagnetic or ferromagnetic material.

36. Magnetically tunable filter according to claim 28, wherein each of the two resonator spheres has a diameter of from 100 μm to 1000 μm.

37. Magnetically tunable filter according to claim 28, wherein the two resonator spheres are arranged mirror-symmetrically to one another on either side of the coupling opening.

38. Magnetically tunable filter according to claim 28, wherein each of the coplanar lines comprising respectively two outer line strips and respectively one central line strip comprise, in the respective end regions of the two filter branches, a short-circuit region where the central line strip of the respective coplanar line is conductively connected to the two outer line strips of the respective coplanar line.

39. Magnetically tunable filter according to claim 28, wherein matching of the characteristic impedance of the respective coplanar line to the characteristic impedance of a connecting resonator formed in the end region of the two filter branches is carried out by a taper.

40. Magnetically tunable filter according to claim 39, wherein the connecting resonator acts as a cavity resonator for an H10 wave mode.

41. Magnetically tunable filter according to claim 28, wherein the matching of the characteristic impedance of the respective coplanar line to the characteristic impedance of a connecting resonator formed in the end region of the two filter branches is carried out by at least one of a $\lambda/4$ transformer and a taper.

42. Magnetically tunable filter according to claim 28, respective filter branch, the corresponding resonator sphere is placed in a short-circuit region of the respective coplanar line by a quartz carrier.

43. Magnetically tunable filter according to claim 42, wherein each resonator sphere is bonded on the quartz carrier by an epoxy adhesive.

* * * * *